US006274848B1

(12) United States Patent
Von Mosshaim

(10) Patent No.: US 6,274,848 B1
(45) Date of Patent: Aug. 14, 2001

(54) MODULAR HOT PLATES

(76) Inventor: Horst Mosshammer Von Mosshaim, 2500 Corporate Exchange, Suite 200, Columbus, OH (US) 43231

( * ) Notice: Subject to any disclaimer, the term of this patent is extended or adjusted under 35 U.S.C. 154(b) by 0 days.

(21) Appl. No.: 09/403,904

(22) PCT Filed: Jan. 26, 1998

(86) PCT No.: PCT/ZW98/00002

§ 371 Date: Oct. 28, 1999

§ 102(e) Date: Oct. 28, 1999

(87) PCT Pub. No.: WO98/41058

PCT Pub. Date: Sep. 17, 1998

(30) Foreign Application Priority Data

Jan. 26, 1997 (ZA) ..... 966369

(51) Int. Cl.[7] ..... H05B 3/68; H05B 3/06

(52) U.S. Cl. ..... 219/452.11; 219/536; 219/537

(58) Field of Search ..... 219/451.1, 452.11, 219/452.12, 536, 537, 538, 539; 126/90 A, 92 AC, 92 A, 92 B

(56) References Cited

U.S. PATENT DOCUMENTS

| | | | | |
|---|---|---|---|---|
| 2,563,875 | * | 8/1951 | Salton | 219/448.11 |
| 3,026,393 | * | 3/1962 | Quirk | 219/537 |
| 3,632,983 | | 1/1972 | Dills . | |
| 3,956,612 | * | 5/1976 | Ballard et al. | 219/539 |
| 4,788,414 | | 11/1988 | Schreder . | |
| 4,900,899 | | 2/1990 | Schreder et al. . | |
| 5,508,495 | * | 4/1996 | Yahav et al. | 219/466.1 |
| 5,530,224 | * | 6/1996 | Sassman | 219/452.12 |

FOREIGN PATENT DOCUMENTS

| | | |
|---|---|---|
| 40 07 680 | 9/1991 | (DE) . |
| 88 03 945 | 8/1998 | (DE) . |

* cited by examiner

*Primary Examiner*—Sang Paik
(74) *Attorney, Agent, or Firm*—Buckingham, Doolittle & Burroughs, LLP; David P. Dureska, Esq.

(57) ABSTRACT

The invention relates to a set of modular table model hot plates for cooking having substantially square or rectangular outlines in plan view, comprising the following features in combination: (a) each hot plate forms a module having one or more sides of the square or rectangular outlines exactly matching one or more sides of one or more other hot plates of the set when placed in close fitting side by side relationship; (b) each hot plate of the set having a vitreous ceramic top covering one or more radiant heating element bodies; (c) said vitreous ceramic tops of the set, when the individual modules are placed side by side with said matching sides in close fitting contact, combine to form a level top surface, interrupted by joint lines of minimal width between the vitreous ceramic tops. A conventional silicone adhesive may be used for bonding the vitreous ceramic top onto the shoulder or flange.

14 Claims, 2 Drawing Sheets

MODULAR HOT PLATES

BACKGROUND OF THE INVENTION

1. Field of the Invention

The present invention relates to table model hot plates for cooking, i.e. self-supporting hot plates for use on a table or like support as distinct on the one hand from cooking plates for fixed installation in the working surface of built-in hot plates of free-standing cooking ranges or stoves.

2. Background of the Invention

In all of the aforegoing, vitreous ceramic tops (a glass-like heat resistant material) covering one or more radiant heating element bodies are becoming increasingly popular because of their appearance, easily cleaned cooking surface and high energy efficiency. Conventionally, if such appliances comprise a plurality of cooking positions, often three or more, each having its own individual, independently controllable radiant heating element body or body set, a single vitreous ceramic top is used to cover all of these. Such large vitreous ceramic tops are relatively expensive and suffer from the disadvantage that any breakage, even if affecting only a small part, e.g. only one of the cooking positions, necessitates replacement of the entire top.

The conventional constructions also afford a very limited range of variety, because it would usually be uneconomical to manufacture more than a small selection of combinations of cooking or warming positions to fit any particular size of vitreous ceramic top. Also, even within such limited scope for variation, if at any stage it should become necessary to change an existing combination, e.g. of different sizes or shapes of cooking positions, it will normally be necessary to replace the entire unit.

Conventional permanently installed constructions usually only lend themselves to a limited choice of installation localities within a given kitchen design. For example the conventional tops of standard appliances such as dishwashers, washing machines or tumble driers do not normally lend themselves for use as supports for a cooking surface. The same applies to loose items of furniture, such as tables or serving trolleys, to mention but a few examples.

A further disadvantage of conventional cooking and warming appliances forming part of permanently installed kitchen furniture is their immobility. If mobility is required, the user will have to invest in additional mobile appliances such as separate table top model hot plates or warming plates and find storage place for such appliances when not in use.

All of the above drawbacks are of even greater impact in the usual domestic environment of disadvantaged population groups where housing conditions may be confined and cramped and where funds for investment in cooking and warming appliances are limited.

These disadvantages, however, also apply in the case of caravans (trailer homes), dormobiles and holiday cabins, where greater mobility of cooking appliances would be a desirable feature.

On the other hand, ordinary movable table top hot plates and warming plates do not solve these problems either. They are but a poor substitute for a built-in or free-standing kitchen range. One of the former alone is usually too small, having fewer than the desired number and less variety of cooking points. Yet to employ two or more of these side by side is unsatisfactory from points of view of aesthetics, space utilisation and cleaning.

There accordingly exists a need to overcome the aforegoing disadvantages.

SUMMARY OF THE INVENTION

The present invention now provides a set of modular table model hot plates for cooking having substantially square or rectangular outlines in plan view, comprising the following features in combination:

a) each hot plate forms a module having one or more sides of the square or rectangular outlines exactly matching one or more sides of one or more other hot plates of the set when placed in close fitting side by side relationship;

b) each hot plate of the set having a vitreous ceramic top covering one or more radiant heating element bodies;

c) said vitreous ceramic tops of the set, when the individual modules are placed side by side with said matching sides in close fitting contact, combine to form a level top surface, interrupted by joint lines of minimal width between the vitreous ceramic tops. The vitreous ceramic tops, which are preferably adhesively bonded in conventional manner onto a marginal shoulder or flange at the top of the base of each unit have outlines as closely as practical matching the plan view outlines of the sides of the units but not projecting these beyond in order not to interfere with the close fitting contact of the sides of adjoining units. A conventional silicone adhesive may be used for bonding the vitreous ceramic top onto the shoulder or flange.

Optionally, but not preferably each vitreous ceramic top may be bordered by retaining ledges, one or more of which constitute the upper part of a side as defined in a). Although these retaining ledges facilitate positioning of the vitreous ceramic tops during assembly and obviate the use of assembly jigs, they impose limitations on the extent to which the joint between adjoining vitreous ceramic tops can be minimised due to the minimum thickness of the material (usually sheet metal) of the ledges.

These ledges, if present, may be as narrow as about 0.5–2.5, more preferably 0.7 to 1.7 mm. say 1 mm. More preferably the ledges are omitted entirely, permitting the vitreous ceramic tops to adjoin as closely as manufacturing tolerances allow.

Preferably the side lengths of the modules are equal to form one or more square modules, or, when different, the longer side lengths are whole number multiples of the shorter side lengths. These side lengths are preferably selected so that they or multiples thereof substantially correspond to standard side lengths of table and appliance tops, in particular standard table tops in modular kitchen furniture.

Preferably one side, usually the front of each module is designed as a control panel carrying operating and/or control buttons, touch pads, knobs and/or dials and optionally one or more pilot lights.

A particular embodiment of such set includes a corner module having essentially square or rectangular outlines as aforesaid, but modified in that one corner is chamfered to form a fifth side, the fifth side, which is preferably considerably shorter than any of the remaining sides, being designed as a control panel carrying operating and/or control buttons, touch pads, knobs or dials and optionally one or more pilot lights.

In use such a set may comprise a plurality of modules arrayed in an L-shaped configuration with a corner module as aforesaid forming the corner of the L. Alternatively, at least one said corner module is set up for the chamfered corner to be at an end of a rectilinear succession of modules. Advantageously, the set includes locating and position retaining means for retaining the modules in their relative positions, having been placed in a selected array. For example, the locating and position retaining means are devices adapted to engage with support buttons or feet of adjoining modules. Alternatively, the locating and position retaining means are catches or clips for locking together the adjoining sides of adjoining modules.

The scope of the invention extends to the individual modules of the set adapted to be used in combination as described above, more particularly by incorporating some or all of the features as set out above.

The individual modules may be supplied with plans and/or instructions, e.g. in or on a package, e.g. a carton containing one or more modules, explaining layouts for combining modules in advantageous arrays.

The invention further includes in its scope, a pentagonal table model hot plate, usable as a corner module in a set as disclosed above, having square or rectangular outlines as aforesaid, one corner of which is chamfered to form a fifth side, this fifth side being designed as a control panel carrying operating and/or control buttons, touch pads, knobs or dials and optionally one or more pilot lights. Besides the visual attractiveness of this design the construction offers the advantage that, when placed on a rectangular or square table or like support, the operating and control means are protected by being recessed in relation to the corner of the support.

BRIEF DESCRIPTION OF THE DRAWINGS

The invention will now be described with reference to the following non-limiting illustrations in which.

DESCRIPTION OF THE PREFERRED EMBODIMENT

Figure 1:
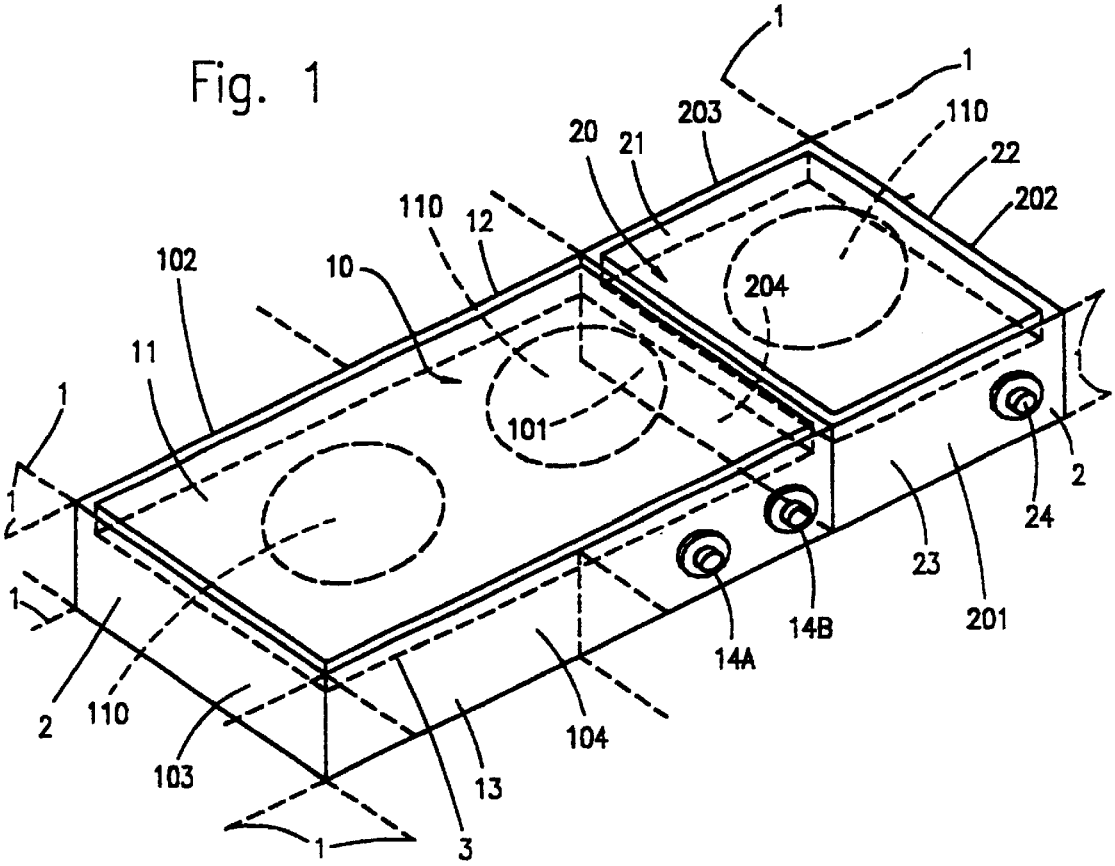
FIG. 1 is an isometric projection of a set of two hot plate modules, assembled in a linear array.

In FIG. 1 there is shown two hot plate modules 10 and 20 combined in a linear array. Hot plate module 10 has rectangular outlines in plan view and hot plate module 20 has square outlines in plan view. Each square hot plate module 20 has four sides of equal length 201, 202, 203 and 204. Each rectangular hot plate module 10 has two opposite short sides 101 and 103 exactly matching in length a side of the square module 20 and two equal opposite long sides 102, 104, the length of which is a multiple, in this example twice the length of the short sides 101, 103.

The hot plates include a base 2, having said rectangular outlines and a vitreous ceramic top 11, 21 covering one or more radiant heating element bodies 110. Each vitreous ceramic top 11, 21 may be bordered by retaining ledges 12, 22, the thickness of which have been greatly exaggerated in the drawing, being in practice only about 1 mm thick, and which if present, constitute the upper part of the sides of the hot plate module. Alternatively and preferably the retaining ledges are omitted entirely.

The vitreous ceramic tops are each bonded with silicone or equivalent adhesive onto a shoulder or marginal flange at 3.

The broken lines 1 indicate that further modules can be added on in a variety of manners to extend the array of modules as needed and to match an available kitchen furniture top area or other working top area. It is clear that the set of modules offers a great many options to meet customer requirements at any given time, while permitting the removal of individual modules for temporary use elsewhere, e.g. in a different room or even outdoors.

The hot plate modules are placed side by side with the matching sides in close fitting contact so that the vitreous ceramic tops 11, 21 of the hot plates combine to form a top level surface, interrupted only by the joint lines formed by the retaining edges 12 and 22.

The longer side lengths of the hot plate module 10 as shown are twice the length of the shorter side lengths. However, it will be understood that modules may be provided having longer side lengths three or more times the shorter side length.

The front side of the modules 13, 23 are designed as control panels carrying control dials 14A, 14B and 24 and optionally pilot lights. The control dials switch on and off and control the temperature of the radiant heating element bodies 110.

The direction in which the control panels of the individual modules are made to face in a given array is optional.

Figure 2:
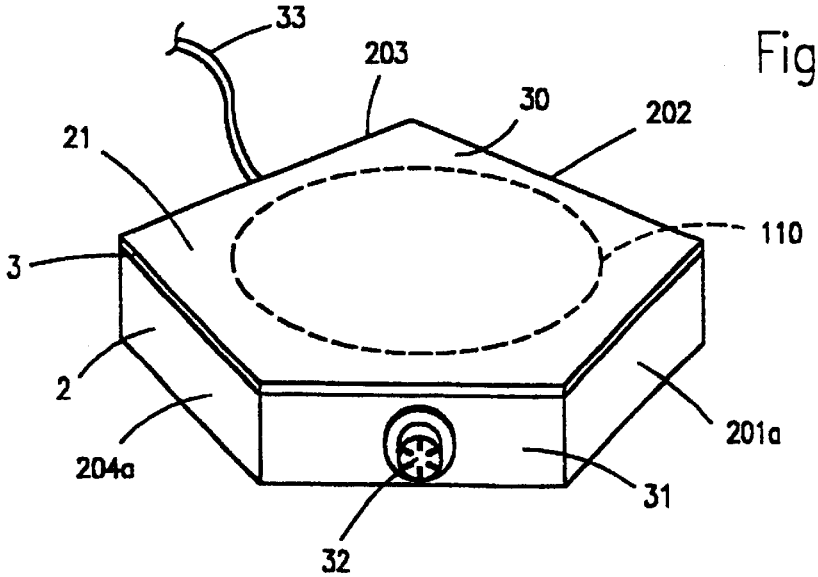
FIG. 2 is an isometric projection of a corner hot plate module, suitable as part of a set including a chamfered corner.

In FIG. 2 there is shown a corner hot plate module having essentially the same square outlines as module 20 in FIG. 1 but modified in that one corner is chamfered to form a fifth side 31 connecting the shortened sides 201*a* and 204*a* The fifth side 31 is considerably shorter than any of the remaining sides and is designed as a control panel and carries a control dial 32 for switching on and off and controlling the temperature of the radiant heating element bodies 110. The module includes a power supply cord 33.

Figure 3:
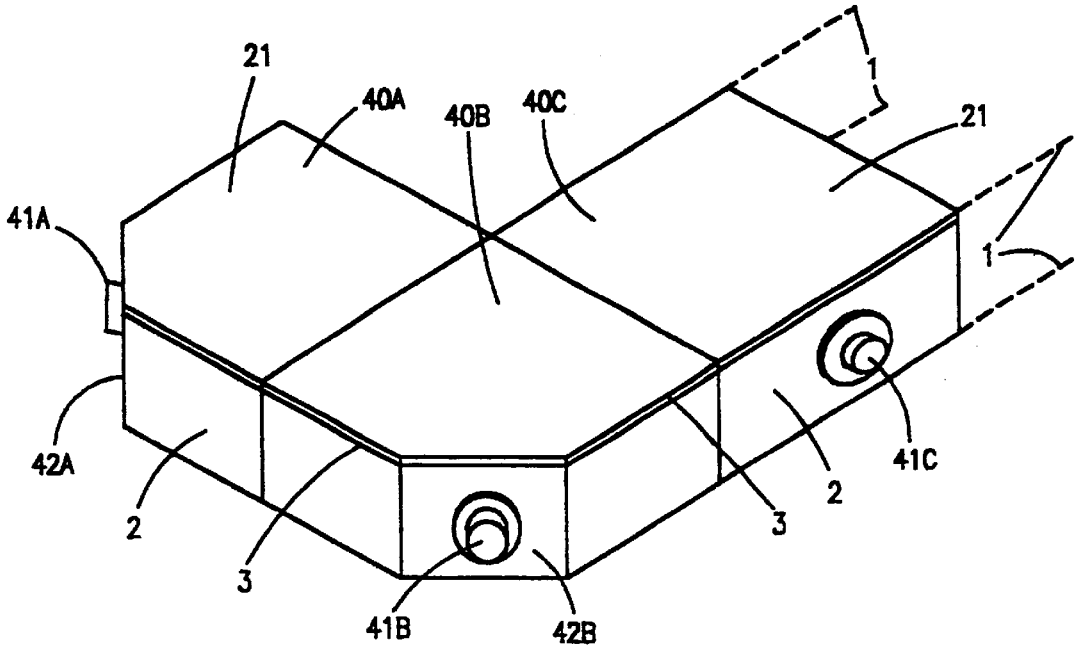
FIG. 3 is an isometric projection of three hot plate modules of a set arranged in an L-shaped configuration.

FIG. 3 illustrates three hot plate modules 40A, 40B and 40C (the latter identical to square module 20 in FIG. 1) arranged in an L-shaped configuration with a corner module 40B as shown in FIG. 2 having a chamfered corner to form a fifth side 42B forming the corner of the L. In addition, a second corner module 40A is set up for fifth side 42A resulting from the chamfered corner to be at an end of the L-shape. As in FIG. 1, broken lines 1 diagrammatically indicate an optional extension of the array with one or more further modules.

Each module includes a control panel (the fifth side of the corner modules) which carries a control dial 41A, 41B and 41C for controlling the temperature of the radiant heating element bodies (not shown).

Figure 5:
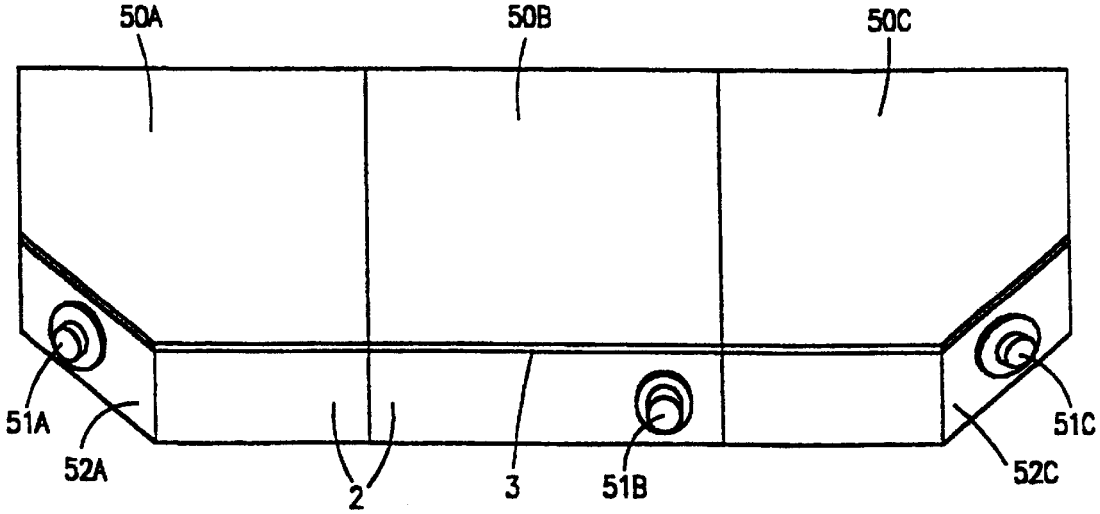
FIG. 5 is a perspective elevation of three hot plate modules of a set arranged in rectilinear succession.

FIG. 5 illustrates three modules 50A, 50B and 50C arranged in rectilinear succession. Two corner modules 50A and 50C as shown in FIG. 2 are set up for the fifth sides 52A and 52C resulting from the chamfered corners to be at either end of the succession of modules. The intermediate module 50B is a square module like module 20 in FIG. 1 or could be a rectangular module like module 10 in FIG. 1. Each module carries a control dial 51A, 51B and 51C on the front control panel (the fifth side in the corner modules). The control dial is for controlling the temperature of the radiant element heating bodies (not shown).

Figure 4:
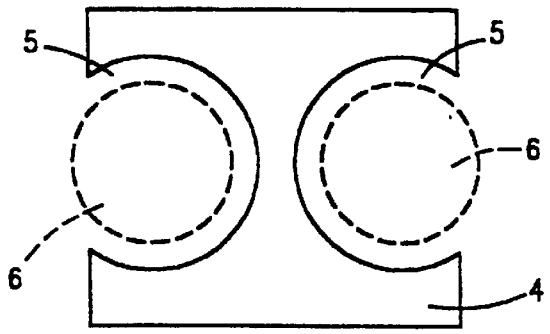
FIG. 4 represents a plan view of a locating clip for holding together adjoining modules of a set.

Referring now to FIG. 4, a resilient clip 4 of rubber is shown having open-ended rebates 5 for accommodating rubber feet 6 on the underside of the corner regions of adjoining modules (not shown). These clips represent one of a variety of possibilities for optionally stabilising the relative positions of adjoining modules in a given array.

The claims which follow are to be considered an integral part of the present disclosure. Reference numbers (directed to the drawings) shown in the claims serve to facilitate the correlation of the integers of the claims with illustrated features of the preferred embodiments, but are not intended to restrict in any way the language of the claims to what is shown in the drawings, unless the contrary is clearly apparent from the context.

What is claimed is:

1. A set of table model hot plates for cooking having substantially square (20) or rectangular (10) outlines in plan view, comprising the following features in combination:

a) each hot plate forms a portable module having one or more sides of the square or rectangular outlines exactly matching one or more sides of one or more other hot plates of the set when placed in close fitting side by side relationship;

b) each hot plate of the set having a vitreous ceramic top (11, 21) covering one or more radiant heating element bodies; and c) said vitreous ceramic tops of the set, when the individual modules are placed with said matching sides in close fitting contact, combine to form a level top surface, interrupted only by joint lines of minimal width between the vitreous ceramic tops.

2. A set as claimed in claim 1, wherein the side lengths of the modules are equal to form one or more square modules or, when different, the longer side lengths are whole number multiples of the shorter side lengths.

3. A set as claimed in claim 1, wherein one side of each module is designed as a control panel carrying operating and/or control buttons, touch pads, knobs and/or dials (14A, 14B, 24) and optionally one or more pilot lights.

4. A set as claimed in claim 1, including a corner module of which one corner of the square or rectangular outlines is chamfered to form a fifth side (31), this fifth side (31) being designed as a control panel carrying operating and/or control buttons, touch pads, knobs or dials (32) and optionally one or more pilot lights.

5. A set as claimed in claim 4 comprising a plurality of the modules arrayed in an L-shaped configuration with a corner module (40B) as aforesaid forming the corner of the L.

6. A set as claimed in claim 1, including locating and position retaining means (4, 5, 6) for retaining the modules in their relative positions, having been placed in a selected array.

7. A set as claimed in claim 6 wherein the locating and position retaining means (4, 5, 6) are devices adapted to engage with support buttons or feet of adjoining modules.

8. A set as claimed in claim 6 wherein the locating and position retaining means (4, 5, 6) are catches, or clips for locking together the adjoining sides of adjoining modules.

9. A set as claimed in claim 4, in which at least one said corner module is set up for the chamfered corner to be at an end of a rectilinear succession of modules.

10. A table model hot plate module for a set as claimed in claim 4, having substantially square (20) or rectangular (10) outlines in plane view adapted to match one or more sides of one or more other hot plates of the set in close fitting relationship and having a vitro-ceramic glass top (11, 21) covering one or more heating element bodies (110), in which one corner of the square or rectangular outlines is chamfered to form a fifth side (31), this fifth side (31) being designed as a control panel carrying operating and/or control buttons, touch pads, knobs or dials and optionally one or more pilot lights.

11. A set of table model hot plates for cooking having substantially square (20) or rectangular (10) outlines in plan view, comprising the following features in combination:

a) each hot plate forms a module having one or more sides of the square or rectangular outlines exactly matching one or more sides of one or more other hot plates of the set when placed in close fitting side by side relationship, said hot plates of the set including a corner module of which one corner of the square or rectangular outlines is chamfered to form a fifth side (31), this fifth side (31) being designed as a control panel carrying operating and/or control buttons, touch pads, knobs or dials (32) and optionally one or more pilot lights;

b) each hot plate of the set having a vitreous ceramic top (11, 21) covering one or more radiant heating element bodies; and c) said vitreous ceramic tops of the set, when the individual modules are placed with said matching sides in close fitting contact, combine to form a level top surface, interrupted only by joint lines of minimal width between the vitreous ceramic tops.

12. A set of table model hot plates for cooking having substantially square (20) or rectangular (10) outlines in plan view, comprising the following features in combination:

a) each hot plate forms a module having one or more sides of the square or rectangular outlines exactly matching one or more sides of one or more other hot plates of the set when placed in close fitting side by side relationship, said hot plates of the set including a corner module of which one corner of the square or rectangular outlines is chamfered to form a fifth side (31), this fifth side (31) being designed as a control panel carrying operating and/or control buttons, touch pads, knobs or dials (32) and optionally one or more pilot lights, whereby a plurality of the modules are arrayed in an L-shaped configuration with a corner module (40B) as aforesaid forming the corner of the L.

b) each hot plate of the set having a vitreous ceramic top (11, 21) covering one or more radiant heating element bodies; and c) said vitreous ceramic tops of the set, when the individual modules are placed with said matching sides in close fitting contact combine to form a level top surface, interrupted only by joint lines of minimal width between the vitreous ceramic tops.

13. A set of table model hot plates for cooking having substantially square (20) or rectangular (10) outlines in plan view, comprising the following features in combination:

a) each hot plate forms a module having one or more sides of the square or rectangular outlines exactly matching one or more sides of one or more other hot plates of the set when placed in close fitting side by side relationship, said hot plates of the set including a corner module of which one corner of the square or rectangular outlines is chamfered to form a fifth side (31), this fifth side (31) being designed as a control panel carrying operating and/or control buttons, touch pads, knobs or dials (32) and optionally one or more pilot lights, wherein at least one said corner module is set up for the chamfered corner to be at an end of a rectilinear succession of modules, b) each hot plate of the set having a vitreous ceramic top (11, 21) covering one or more radiant heating element bodies; and c) said vitreous ceramic tops of the set, when the individual modules are placed with said matching sides in close fitting contact, combine to form a level top surface, interrupted only by joint lines of minimal width between the vitreous ceramic tops.

14. A set of table model hot plates for cooking having substantially square (20) or rectangular (10) outlines in plan view, comprising the following features in combination:

a) each hot plate forms a module having one or more sides of the square or rectangular outlines adapted to match one or more sides of one or more other hot plates of the set in close fitting relationship, said hot plates of the set including a corner module of which one corner of the square or rectangular outlines is chamfered to form a fifth side (31), this fifth side (31) being designed as a control panel carrying operating and/or control buttons, touch pads, knobs or dials (32) and optionally one or more pilot lights;

b) each hot plate of the set having a vitro-ceramic glass top (11, 21) covering one or more heating element bodies; and c) said vitro-ceramic glass tops of the set, when the individual modules are placed with said matching sides in close fitting contact, combine to form a level top surface, interrupted only by joint lines of minimal width between the vitro-ceramic glass tops.

* * * * *